United States Patent [19]

Brown

[11] 4,433,639

[45] Feb. 28, 1984

[54] APPLICATION FOR SPRAYING LIQUID CHEMICAL ONTO DRILL PIPE

[76] Inventor: William H. Brown, 11137 - 29A Avenue, Edmonton, Alberta, Canada, T6J 3Z4

[21] Appl. No.: 383,549

[22] Filed: Jun. 1, 1982

[51] Int. Cl.[3] ..... B05C 5/00; B05C 15/00

[52] U.S. Cl. ..... 118/316; 118/125; 118/326; 118/DIG. 11; 118/DIG. 18; 15/256.6

[58] Field of Search ..... 118/316, 307, 305, DIG. 11, 118/DIG. 18, 326, 125, 100, 72; 184/15 R; 15/256.6, 104.04; 166/82, 83, 84, 244 C

[56] References Cited

U.S. PATENT DOCUMENTS

| | | | |
|---|---|---|---|
| 2,667,929 | 2/1954 | Hunt | 15/104.04 |
| 2,960,706 | 11/1960 | Dunham | 15/104.04 |
| 3,334,639 | 8/1967 | Grant | 118/316 |
| 3,840,384 | 10/1974 | Reade et al. | 118/DIG. 11 |
| 3,851,623 | 12/1974 | Landry, Jr. | 118/405 |
| 4,169,427 | 10/1979 | Crump et al. | 118/307 |

*Primary Examiner*—John P. McIntosh

*Attorney, Agent, or Firm*—Max L. Wymore

[57] ABSTRACT

The applicator is annular in configuration, having top and bottom walls formed of elastic material. The central openings through these walls are undersized, so that the walls seal around the string of pipe passing through the openings. The applicator is mounted on the string and is free to move laterally with it. Thus there is provided a free-floating, sealed, annular spray chamber mounted on the string and free to move laterally with it. A ring of nozzles is mounted within the chamber for spraying the string. A pump and conduit supply pressurized chemical to the nozzles. A vacuum pump and conduit suck excess chemical from the chamber for recovery.

7 Claims, 9 Drawing Figures

APPLICATION FOR SPRAYING LIQUID CHEMICAL ONTO DRILL PIPE

BACKGROUND OF THE INVENTION

1. Field of the Invention

This invention relates to apparatus for spraying liquid chemical onto the outer surface of a string of pipe or rod moving into or out of a wellbore.

2. Description of the Prior Art

Corrosion and hydrogen embrittlement have long been factors which have deleteriously affected pipe and rod strings. There are known liquid chemicals which may be applied to a string to alleviate this deterioration. However, it frequently happens that it is necessary to apply such liquid when the string is being tripped in or out of the wellbore.

For this purpose, an applicator system is required. Since the chemicals involved are expensive, such an applicator system should be adapted to minimize chemical loss.

Heretofore, John Grant has disclosed, in U.S. Pat. Nos. 3,306,310, 3,334,639, 3,378,088 and 3,475,781, an applicator system which involves the following features. It comprises an applicator which has an annular housing. This housing is mounted on the wellhead or is bolted to the I-beams of the rig sub-structure. In other words, the housing is fixed. Mounted within the housing is a ring of spaced nozzles; the nozzles are adapted to spray the string passing vertically through the central opening of the annular applicator. The nozzles are supplied by suitable means with pressurized liquid chemical.

Because the Grant applicator is fixed, the central opening through which the string extends has to be larger than the outside diameter of the string. To quote the patents, there has to be "ample clearance" between the housing and the string. This is so because the pipe or rod string has a tendency to swing back and forth laterally as it is being pulled from or run into the wellbore. If the applicator housing is contacted by the swaying string, it will likely be damaged.

Grant's system therefore involves the concept of a fixed housing with ample clearance, containing a fixed ring of nozzles, used in conjunction with a laterally moving string. There are disadvantages arising from this approach. Excess liquid chemical, which does not adhere to the string, is lost, as it drops through the clearance. Also, the "standoff" or distance between the nozzles and the string is constantly changing; this means that the pressure of the spray contacting the string varies, as does the spray pattern.

There is therefore still a need for an applicator system which is adapted to conserve or recover excess chemical and whose spray pattern and pressure at the string surface is generally constant.

SUMMARY OF THE INVENTION

In accordance with a preferred feature of this invention, an annular applicator is provided which is "free floating"—that is, it is not secured to the wellhead or to the rig sub-structure; instead, it is mounted directly on the string and is free to move laterally with it.

To achieve this end, the annular housing is provided with top and bottom walls of elastic material, such as a rubber-base composition, elastomer or the like. The aligned openings in these walls, through which the string passes, are slightly undersized—the walls therefore have to stretch to pass the string and tightly grip it to provide a liquid-tight seal therewith. The housing therefore provides an annular, free-floating, sealed spray chamber surrounding the string. The stretchable walls permit the string, including its tool joints, to pass through the applicator while maintaining top and bottom seals. A generally horizontal ring of spaced nozzles, which may be supplied with pressurized liquid chemical, is mounted in the housing to spray the string.

The applicator is adapted for use with a suction means, such as a return line and vacuum pump, for recovering excess chemical from the spray chamber.

According to one broad aspect, the invention comprises an applicator for spraying liquid chemical onto a pipe or rod string moving therethrough, said string having a varying outside diameter, comprising: an annular housing mountable on the string and having a side wall and elastic, solid top and bottom walls which form a spray chamber, said latter walls forming aligned openings through which the string may pass, said openings each being undersized relative to the smallest outside diameter of the string to pass therethrough and having a sealing surface adapted to grip the string outer surface to provide a substantially liquid-tight seal therewith, said housing, when in use, being free to move laterally with the string; and a ring-like nozzle assembly, associated with the housing and mounted within the spray chamber, for spraying the string.

According to another broad aspect, the invention comprises, in combination, (a) an applicator, for spraying liquid chemical onto a pipe or rod string moving therethrough, said string having a varying outside diameter, comprising: an annular housing mountable on the string and having a side wall and elastic, solid top and bottom walls which form a spray chamber, said latter walls forming aligned openings through which the string may pass, said openings each being undersize relative to the smallest outside diameter of the string to pass therethrough and having a sealing surface adapted to grip the string outer surface to provide a substantially liquid-tight seal therewith, said housing, when in use, being free to move laterally with the string; and a nozzle assembly, associated with the housing and comprising a ring of nozzles mounted within the spray chamber, for spraying the string; (b) means for supplying liquid chemical to the nozzle assembly for spraying; (c) and means for drawing excess liquid chemical from the spray chamber for recovery.

The invention is characterized by two key advantages. By mounting the applicator on the string in free-floating mode and making it seal therearound, excess chemical is kept within the spray chamber and may be recovered therefrom. Also, the nozzle assembly, being associated with the housing and movable therewith, is adapted to have its nozzles at a fixed distance from the string; thus spray pressure and coverage at the string surface remain substantially constant.

DESCRIPTION OF THE PREFERRED EMBODIMENT

Figure 1:
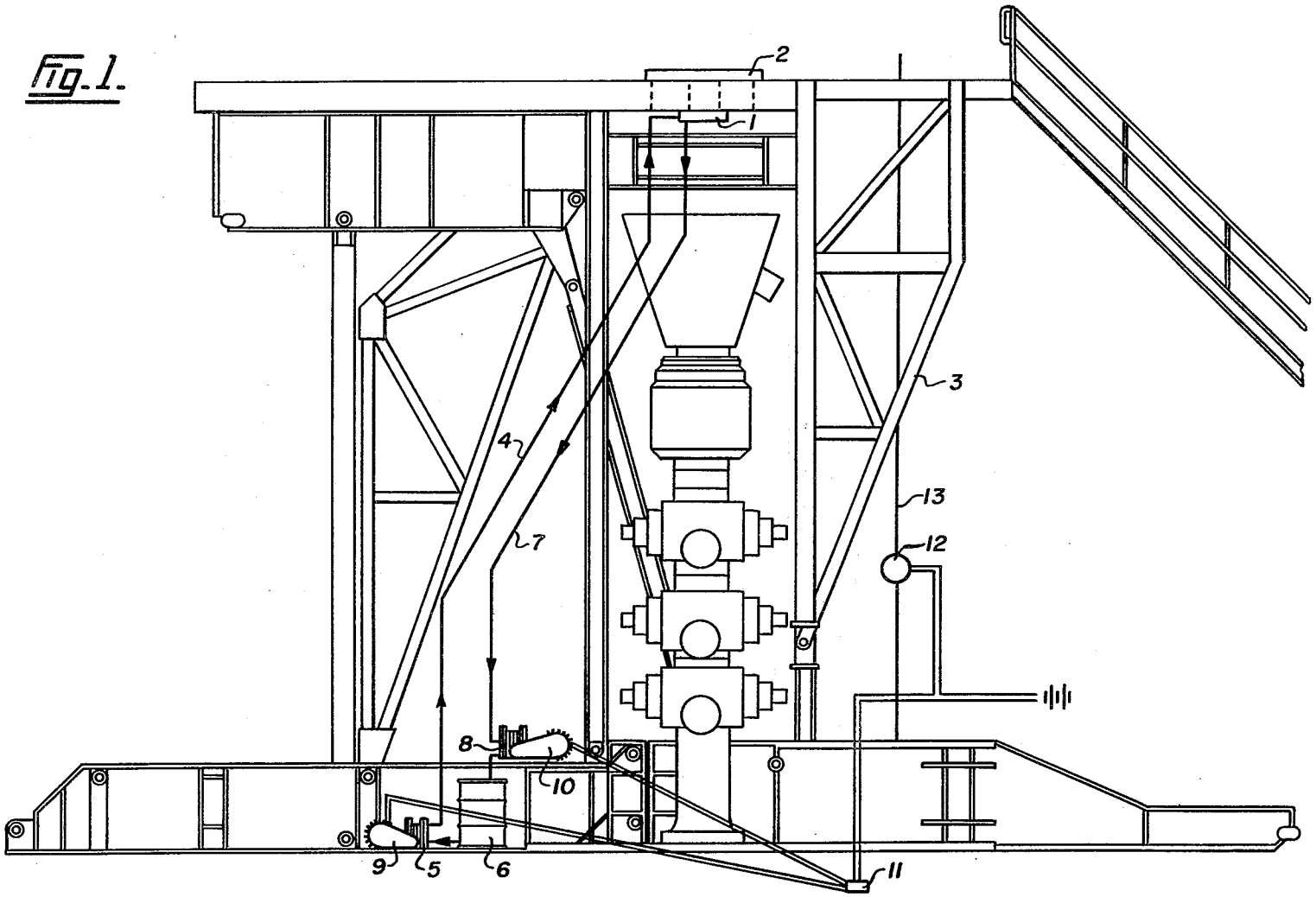
FIG. 1 is a side schematic view showing the chemical applicator system incorporated within the sub-structure of a drilling rig.
Figure 2:
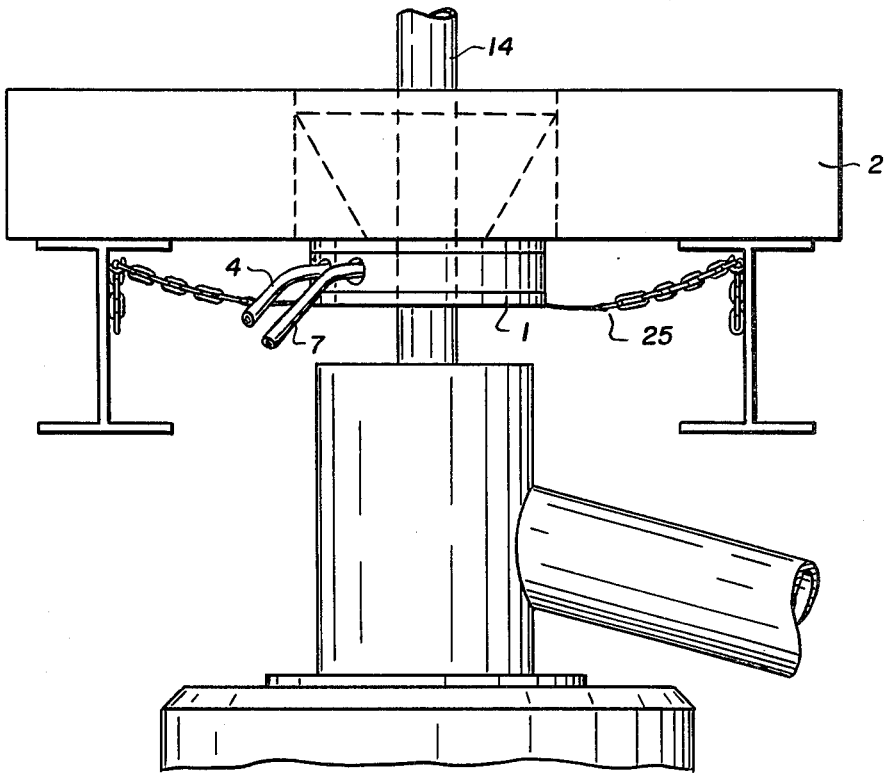
FIG. 2 is a side schematic view showing the applicator in place beneath the rotary table of a drilling rig.
Figure 6:
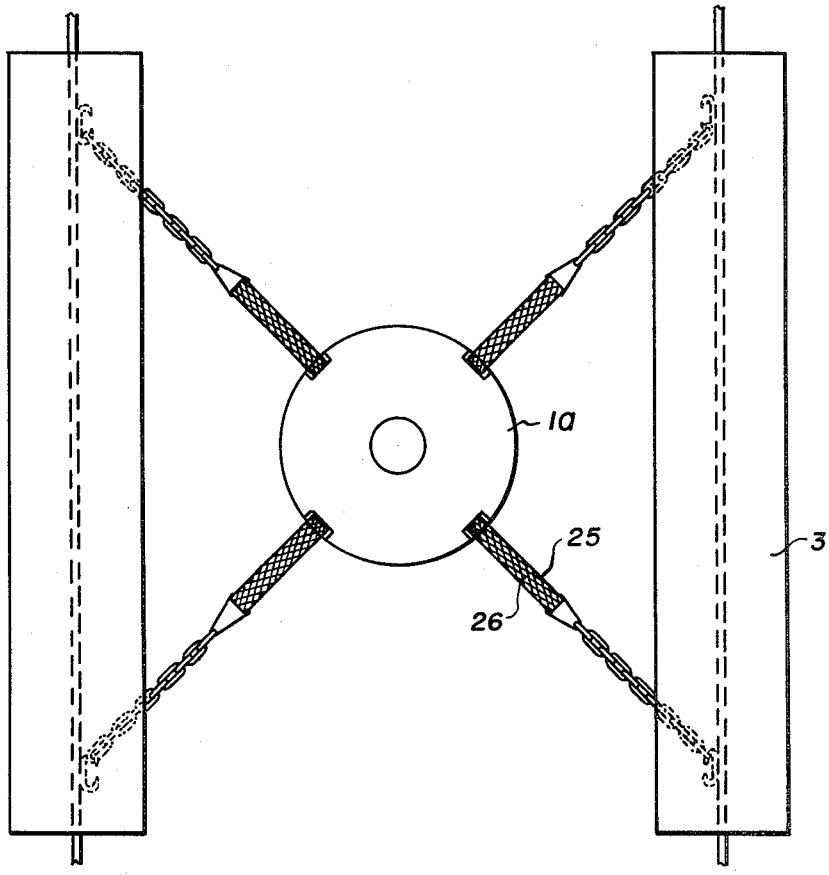
FIG. 6 is a top view showing the applicator secured to the rig sub-structure beams by connectors which restrain rotation of the applicator while permitting lateral movement thereof.

Having reference to FIG. 1, there is shown an applicator 1, positioned beneath the rotary table 2 of a rig sub-structure 3.

A flexible, high pressure injection hose 4 connects the applicator 1 with an injection pump 5. The suction end of the injection pump 5 is connected with a supply barrel 6, containing liquid chemical. The hose 4, pump 5 and barrel 6 together make up means for the supply of the liquid chemical to be sprayed. A flexible return hose 7 connects the applicator 1 with a vacuum pump 8; the discharge end of this vacuum pump 8 is connected with the barrel 6. The return hose 7 and vacuum pump 8 together make up means for drawing excess liquid chemical from the applicator 1, for recovery.

A pair of electric motors 9, 10 drive the injection and vacuum pumps 5, 8. The motors 9, 10 are actuated by a solenoid 11 which is responsive to a sensor 12. The sensor 12 is connected with the drilling line 13 of the drilling rig (not shown) and senses load on said line. The motors 9, 10 are actuated when the rig is hoisting or lowering the string 14.

The injection pump 5 functions to pump liquid chemical from the barrel 6 to the applicator 1 at high pressure—for example, 600 psig. The vacuum pump 8 functions to draw excess liquid chemical out of the applicator 1 and return it to the barrel 6.

The applicator 1 comprises a housing 1*a* having a vertical, circular side wall 15 and horizontal top and bottom walls 16, 17. The walls 15, 16, 17 are secured together by bolt assemblies 18, to form a unit defining an interior spray chamber 19.

The top and bottom walls 16, 17 have aligned, central, circular openings 20, 21 formed therethrough, through which the pipe string 14 passes. Thus the housing 1*a* is annular in configuration. While it is shown in circular form, it will be understood that forms other than circular are intended to fall within the purview of the term "annular".

The side wall 15 is preferably formed of a spark-proof material, such as urethane. The top and bottom walls 16, 17 are formed of elastic material. I prefer to use 1¼" thick slabs of rubber-containing composition having a Shore durometer hardness of 52 and being resistant to degradation by hydrocarbons and the chemicals being sprayed. The selection of the material is not a factor in the invention. The material needs to be stretchable to accommodate the passage of tool joints and it should be durable under the conditions of use.

The openings 20, 21 are slightly undersize relative to the outside diameter of the pipe or rod to pass therethrough. For example, with 4½" O.D. drill pipe, the diameter of the top opening 20 typically may be 4⅛"; the diameter of the bottom opening may be 4⅜". Thus the almost vertical sealing surfaces 23, 24 of the openings 20, 21 tightly grip the string 14 to provide a substantially liquid-tight seal therewith.

The bottom wall 17 is preferably cut at a slant to form the opening 21, so that the sealing surface 24 is at an outward inclination from top to bottom of about 10° from vertical. Slanting of the sealing surface 24 ensures that, when the string 14 is being tripped, said surface maintains contact with the string over substantially all of the former's width.

If the sealing surface 24 is not so slanted, its upper portion tends to peel away from the string surface during tripping. Excess liquid chemical tends to accumulate in the crack so formed and, when an enlargement, such as a tool joint, slams through the wall 17, this collected chemical tends to escape.

Figure 3:
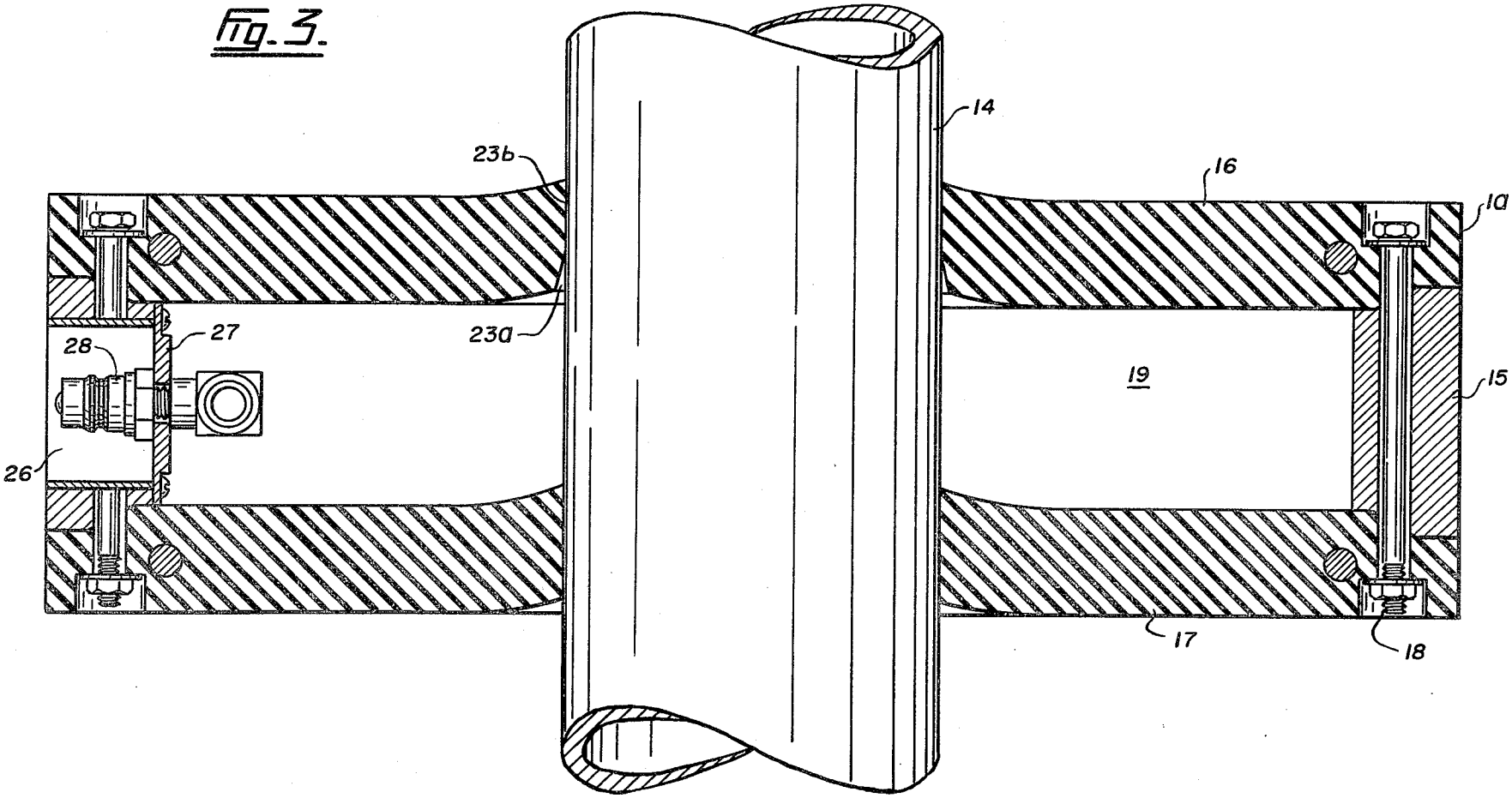
FIG. 3 is a side sectional view of the applicator showing a section of pipe passing therethrough.
Figure 4:
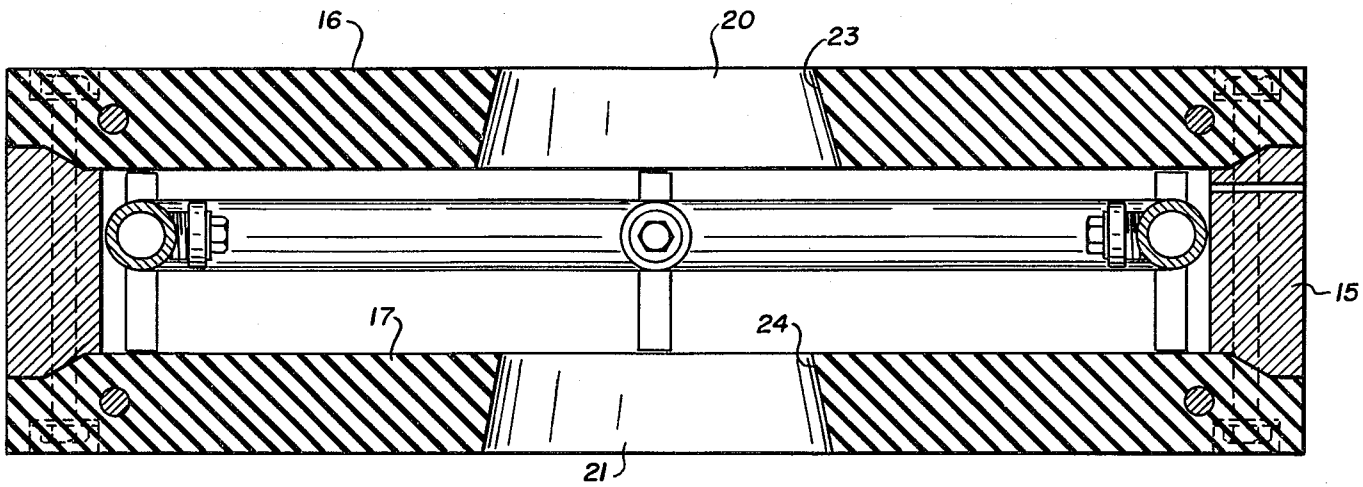
FIG. 4 is a side sectional view of the applicator.
Figure 5:
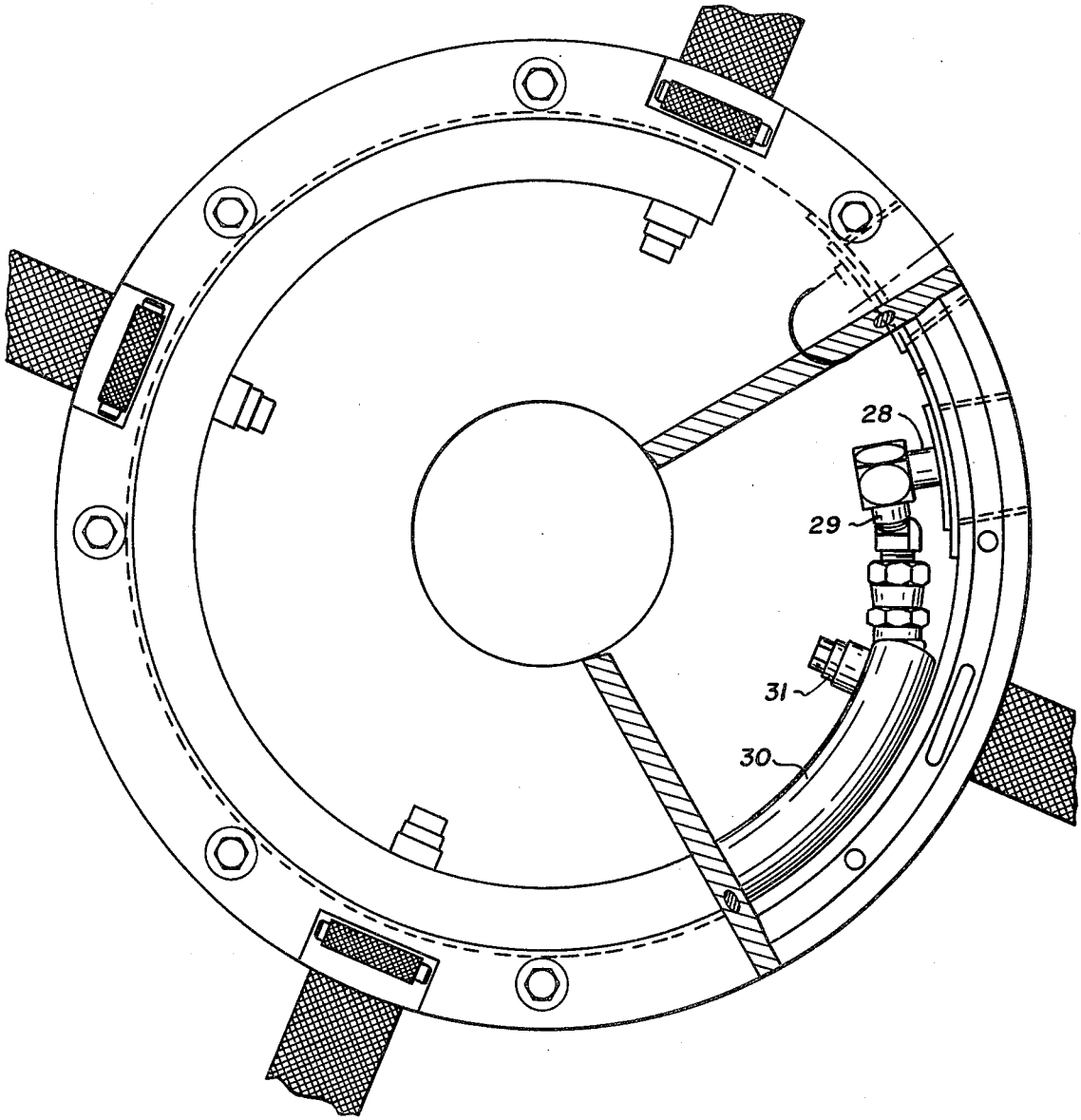
FIG. 5 is a top cutaway view of the applicator.

The top wall 16 is also preferably cut at a slant to form the opening 20, so that the sealing surfaces 23 is at an angle of about 14° from vertical. This angularity is selected with the concept in mind of having the sealing surface 23 slightly peeled away from the pipe 14, to develop a clearance 23*a* as shown in FIG. 3. It is believed that a reservoir of liquid chemical collects in the clearance 23*a* to ensure that the pipe receives a coating. The upper portion 23*b* of the surface 23, which is in contact with the pipe surface, functions to wipe excess chemical from said surface and to smear it on the surface in a well distributed manner.

It will be noted that the housing 1*a* is free-floating; that is, it is mounted directly on the pipe string 14 and is not fixed to the wellhead or the rib sub-structure. Thus it is free to move laterally with the string.

Chains 25, having elastic ends 26, connect the substructure 3 and housing 1*a*. These chains 25 only function to restrain rotational movement of the applicator 1; they do not deleteriously interfere with the string's lateral movement.

A port 26 is formed through the housing side wall 15. A plate 27 extends across the inner end of the port 26 and is bolted to said side wall. A bored quick-connect fitting 28 is mounted on the plate 27 and communicates through connectors 29 with a ring conduit 30 mounted within the spray chamber 1*a*. The fitting 28 is adapted to connect with a complementary fitting (not shown) on the end of the injection hose 4. A flow channel for liquid chemical is defined through the hose 4, fitting 28 and connectors 29 into the bore of the ring conduit 30.

Figure 7:
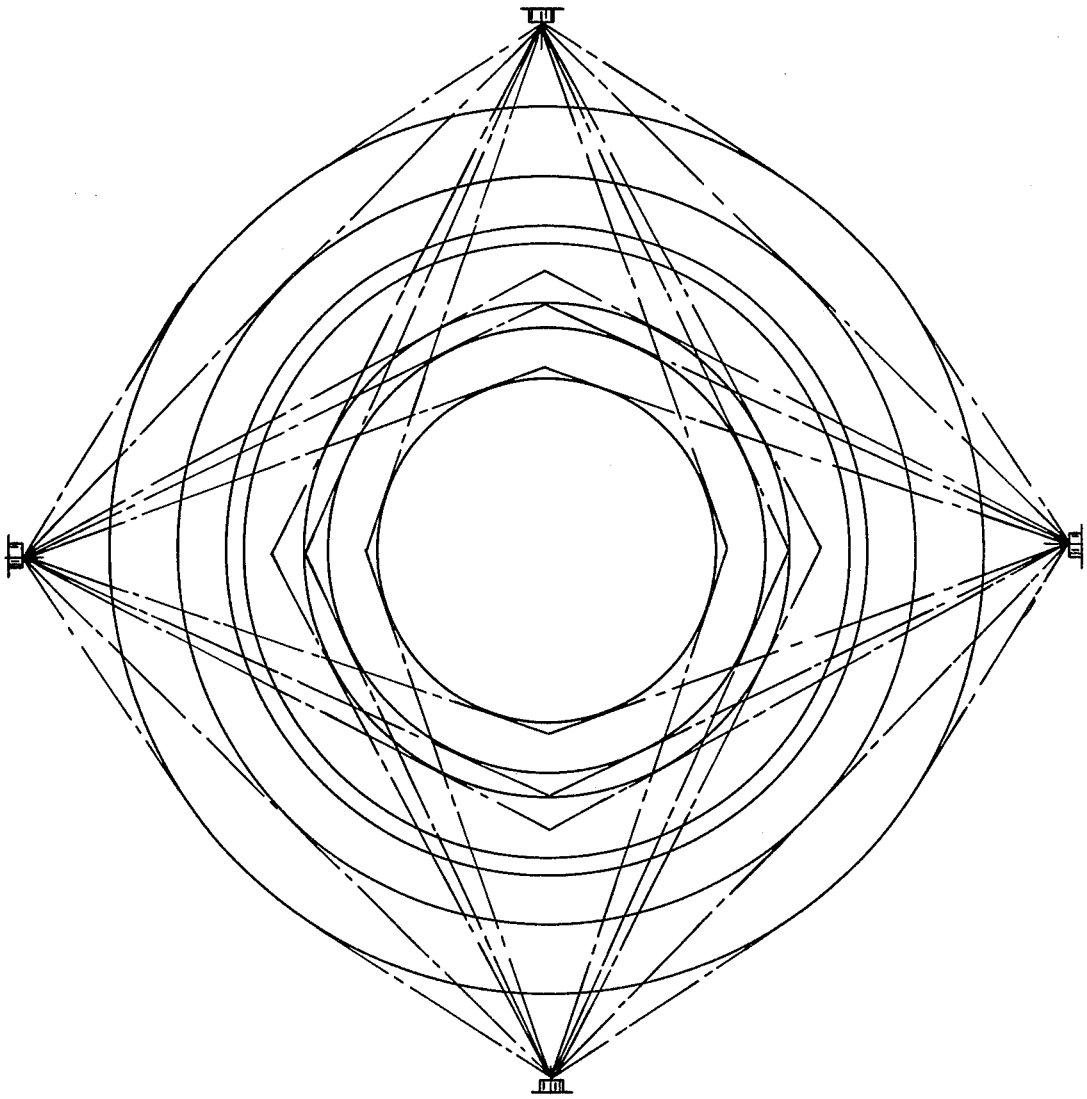
FIG. 7 is a chart showing the sprays produced by different size nozzles and the correlation between these sprays and pipes of different outside diameters.
Figure 8:
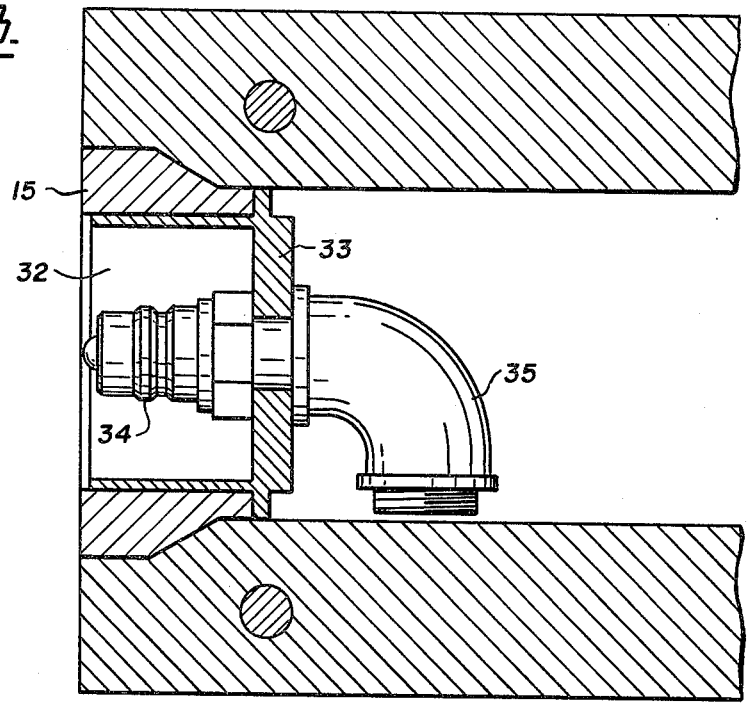
FIG. 8 is a side sectional view showing the vacuum return line port.
Figure 9:
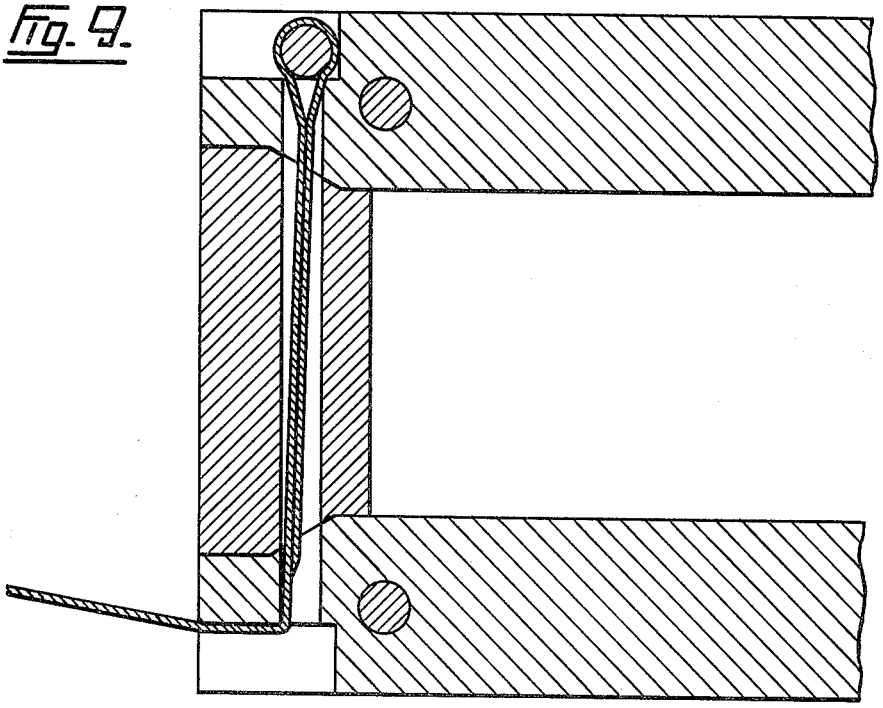
FIG. 9 is a detail side sectional view showing the connection of the restraining connectors and the housing.

A plurality of spaced nozzles 31 are connected with and are fed by the ring conduit 30. The nozzles 31 are arranged to spray inwardly to coat the portion of the string 14 extending at any moment through the spray chamber 1*a*. Suitable nozzles are those commercially available for wash-down guns or chemical fertilizer spray devices. Opposed nozzles may suitably be spaced apart 10¾". The chart in FIG. 7 shows spray patterns of nozzles of this type and in this arrangement, which may be used for pipes of different diameter, as shown.

A second port 32 is formed in the housing side wall 15. A plate 33 extends across the inner end of the port 32 and is fixed to the side wall. A bored, quick-connect fitting 34, for connection with the vacuum return hose 7, is mounted on the plate 33. An elbow 35 is connected with the fitting 34 and extends down toward the floor of the spray chamber 19. When suction is applied by the vacuum pump 8, excess chemical in the spray chamber 19 may be withdrawn through the return hose 7.

When the pump 5 is actuated, liquid chemical is sprayed, preferably at high pressure, onto the string 14. The spray is effective to remove residual water and mud film from the pipe and to bring the chemical into intimate contact with the string surface, to which it has a tendency to adhere. The sealing surface 23 of the top wall 16 smears the chemical evenly on the string 14 and wipes off the excess, so that it remains in the spray chamber 19. The sealing surface 24 of the bottom wall 17 seals around the string 14 so that the chemical may not escape. The vacuum pump 8 is operative to draw this excess out of the spray chamber 14 and returns it to the barrel 6.

This description is specific to the embodiment shown in the following drawings. The scope of the invention is defined by the claims now following.

The embodiments of the invention in which an exclusive property or privilege is claimed are defined as follows:

1. An applicator, for spraying liquid chemical onto a pipe or rod string moving therethrough, said string having a varying outside diameter, comprising:

an annular housing mountable on the string and having a side wall and elastic, solid top and bottom walls which form a spray chamber, said latter walls forming aligned openings through which the string may pass, said openings each being undersize relative to the smallest outside diameter of the string to pass therethrough and having a sealing surface adapted to grip the string outer surface to provide a substantially liquid-tight seal therewith, said housing, when in use, being free to move laterally with the string; and a ring-like nozzle assembly, mounted within the spray chamber, for spraying the string.

2. The applicator as set forth in claim 1 wherein:

the bottom sealing surface is slanted outwardly from vertical substantially from top to bottom, to promote contact between said surface and the string.

3. The applicator as set forth in claim 2 wherein:

the top sealing surface is inclined at an angle, outwardly from vertical from substantially top to bottom, of about 14°;

and the bottom sealing surface is inclined at an angle, outwardly from vertical substantially top to bottom, of about 10°.

4. In combination:

(a) an applicator, for spraying liquid chemical onto a pipe or rod string moving therethrough, said string having a varying outside diameter, comprising:

an annular housing mountable on the string and having a side wall and elastic, solid top and bottom walls which form a spray chamber, said latter walls forming aligned openings through which the string may pass, said openings each being undersize relative to the smallest outside diameter of the string to pass therethrough and having a sealing surface adapted to grip the string outer surface to provide a substantially liquid-tight seal therewith, said housing, when in use, being free to move laterally with the string; and a nozzle assembly comprising a ring of nozzles mounted within the spray chamber, for spraying the string;

(b) means for supplying liquid chemical to the nozzle assembly for spraying;

(c) and means for drawing excess liquid chemical from the spray chamber for recovery.

5. The applicator as set forth in claim 4 wherein:

the top and bottom sealing surfaces are slanted outwardly from vertical substantially from top to bottom.

6. In combination:

(a) a rig tripping a pipe string having a varying outside diameter;

(b) an applicator for spraying liquid chemical onto said string, comprising:

an annular housing mounted on the string and having a side wall and elastic, solid top and bottom walls which form a spray chamber, said latter walls forming aligned openings through which the string extends, said openings each being undersize relative to the smallest outside diameter of the string passing therethrough and having a sealing surface which grips the string outer surface to provide a substantially liquid-tight seal therewith, said housing being free to move laterally with the string; and a nozzle assembly, comprising a ring of nozzles mounted within the spray chamber, for spraying the string;

(c) means for supplying liquid chemical to the nozzle assembly for spraying; and (d) means for drawing excess liquid chemical from the spray chamber for recovery.

7. The applicator as set forth in claim 6 wherein:

the top and bottom sealing surfaces are slanted outwardly from vertical substantially from top to bottom.

* * * * *